United States Patent [19]

Perla

[11] 4,440,525

[45] Apr. 3, 1984

[54] DIVERS WEIGHT BELT

[75] Inventor: Henry L. Perla, Orlando, Fla.

[73] Assignee: H.I.M. Inc., Orlando, Fla.

[21] Appl. No.: 326,542

[22] Filed: Dec. 2, 1981

[51] Int. Cl.[3] ..... B63C 11/30

[52] U.S. Cl. ..... 405/186; 224/229

[58] Field of Search ..... 405/186; 2/311, 312; 224/228, 229

[56] References Cited

U.S. PATENT DOCUMENTS

| | | | |
|---|---|---|---|
| 1,418,371 | 6/1922 | Foster | 224/229 X |
| 3,374,636 | 3/1968 | Mason | 405/186 |
| 3,664,560 | 5/1972 | Perkins | 2/312 X |
| 3,713,299 | 1/1973 | Duncan | 405/186 |
| 4,139,133 | 2/1979 | Repka | 224/229 |
| 4,341,331 | 7/1982 | McDougall | 224/229 X |

*Primary Examiner*—David H. Corbin

*Attorney, Agent, or Firm*—Duckworth, Allen, Dyer & Pettis

[57] ABSTRACT

A divers weight belt formed from a single piece of laminated material having closed cell foam neoprene covered on each side with stretchable fabric. A plurality of rectangular pockets are formed along the belt to hold standard rectangular led diving weights. An upward extending flap of the material is provided with Velcro ® closure material and the outer surfaces of the pockets provided with mating Velcro ® closure material to permit closing of the pockets. Two ends of the belt project from the pockets and are provided with Velcro ® closure material. The diver places a belt with desired weights inserted in the pockets around his waist with the pocket flap contacting his weight and closes the belt by engaging the Velcro ® ends. In an emergency, the belt can be quickly dropped by ripping the ends apart.

8 Claims, 2 Drawing Figures

DIVERS WEIGHT BELT

BACKGROUND OF THE INVENTION

1. Field of the Invention

The present invention relates to weights for divers and more particularly to a comfortable and safe adjustable belt for holding diving weights for scuba divers.

2. Description of the Prior Art

Scuba divers must often utilize weights to conveniently maintain a desired depth in the water. It is necessary that the weights be adjustable to be adaptable to the weight of the diver and the depth at which he wishes to work. A type of weight has become standard in the sport which is cast in lead in various weight ranges, roughly in the form of a buckle. A nylon belt or the like is woven through open spaces in the weights and fastened around the waist of the diver by means of a belt buckle. The total weight is controlled by the number and sizes of the weights threaded on the belt. As may be recognized, it is difficult to change weights once installed on the diver since the belt must be unbuckled and weights either slipped on or off. When worn without a wet suit, this type of belt weight system is extremely uncomfortable since the corners of the lead weights may dig into the diver's flesh and can cause bruises and abrasions in some instances. Even when worn over a wet suit, the weights may still be very uncomfortable. Another shortcoming of this system is that the weights may slide on the belt while in use which can result in an unbalancing of the diver and make it difficult for him to function properly. Another difficulty of the lead weights is that they can damage boats and other objects if accidently bumped while the diver is wearing the belt.

Other weight belts have utilized a simple belt having several pockets suspended therefrom which are filled with sand or with lead shot to produce the desired weighting. The suspended pockets tend to swing and to hit against the diver in use, are easily spilled and inconvenient to use. Thus, there is a need for a simple, safe and comfortable weight belt that can be worn with or without wet suits, is easily adjustable and in which the weights are secure.

SUMMARY OF THE INVENTION

The present invention is a novel diver's weight belt formed from a single piece of material. The preferred material is a closed-cell foam neoprene, laminated with nylon, lycra, or the like on both sides. The material is folded and sewed so as to form a belt having a plurality of pockets on one side thereof. The flap of the material extends above the pockets and is arranged to fold down over the pockets so as to provide closure thereto. The two ends of the belt extend from either end of the row of pockets and have strips of Velcro® material attached thereto. Similarly, the outside of the pockets each have a strip of Velcro® with a matching strip on the inner side of the flap. The pockets are made to match the size of standard rectangular lead weights which are available in weights of 1 to 5 pounds each in increments of one pound. The desired weights are slipped into the pockets and the mating Velcro® materials pressed together to securely lock the weight into the pockets. When the belt is donned by the diver, the flap side of the belt is placed in contact with the diver's waist and the belt ends are joined together by the mating Velcro® strips. As may now be recognized, the diver's body serves to hold the pocket flaps securely closed so that it is impossible for the flap to accidently open such that weights might spill out. More importantly, it may be noted that there will be two thicknesses of the foam padded neoprene material between the diver's body and the lead weights as well as the two strips of Velcro®. The cushioning effect of such interposed material ensures maximum comfort to the diver when he is not wearing a wet suit and even more comfort when the belt is used over a wet suit.

With the weight belt of the invention, weights can be easily changed without removing the belt and the entire belt may be very quickly released by simply pulling on the Velcro® closure. Thus, in a diving emergency, the diver may quickly get rid of the weight. Since each of the lead weights utilized is completely enclosed by the foam neoprene material, there is little, if any, possibility of damage by bumping the weight belt against objects. Similarly, the diver is well protected against bruising or other injuries from the weights even upon bumping into objects. The diver may also select the number and value of the weights and install them in the appropriate pockets so as to be perfectly balanced with no danger of a weight shifting during use.

It is therefore a principal object of the invention to provide a diver's weight belt having means for accepting standard lead weights which will be comfortable for the diver to wear, either with or without a wet suit.

It is another object of the invention to provide a diver's weight belt in which each weight is carried in an independent pocket having a flap covering, with the flap between the pocket and the diver to prevent accidental opening of the pocket.

It is still another object of the invention to provide a diver's weight belt in which each weight is carried in a separate pocket such that the weights may be balanced with respect to the diver and in which there is no possibility of the weights slipping in position.

It is yet another object of the invention to provide a diver's weight belt having a Velcro® closure for holding the belt around the diver's waist such that the weight may be dropped very quickly in an emergency.

It is a further object of the invention to provide a diver's weight belt in which lead weights may be used which will be completely covered with shock absorbing material such that the weights cannot damage other objects.

It is still a further object of the invention to provide a diver's weight belt in which there are two layers of closed cell foam neoprene between the diver and the weights.

These and other objects and advantages of the invention will be apparent from the following detailed description and the drawings.

DETAILED DESCRIPTION OF THE PREFERRED EMBODIMENT

Figure 1:
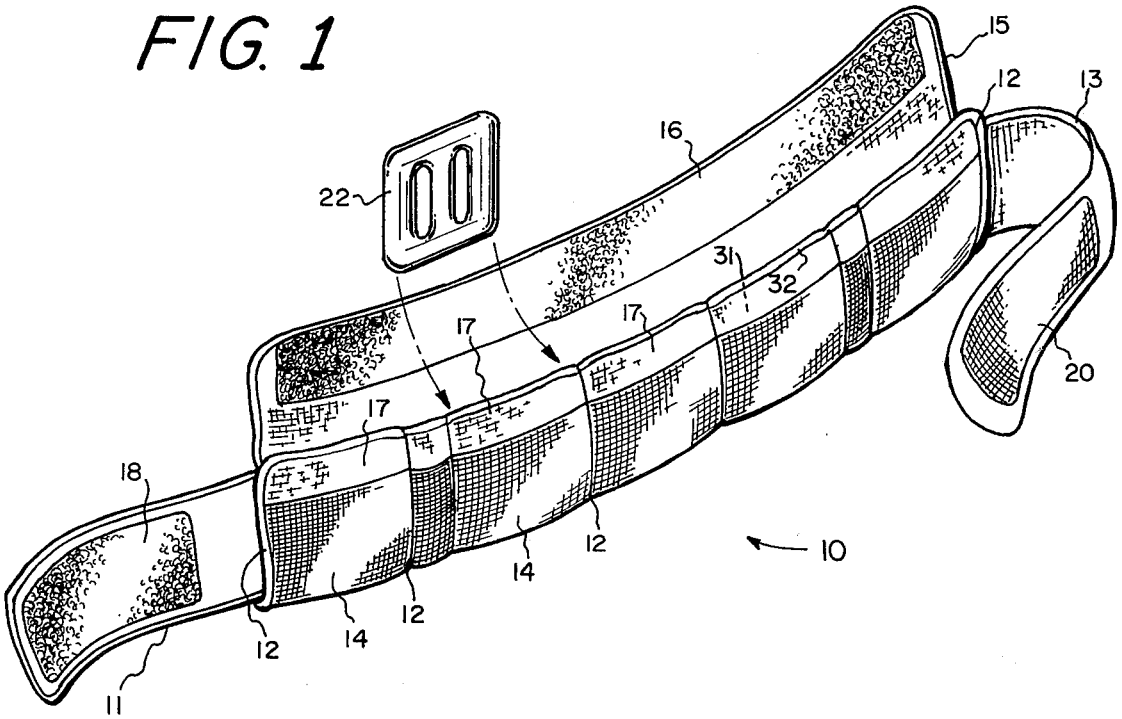
FIG. 1 is a perspective view of the weight belt in an open position with no weights installed showing the insertion of a weight.

Referring to FIG. 1, a perspective view of the weight belt of the invention is shown generally at 10. The weight belt 10 is formed basically from a single piece of material which is preferably a closed cell foam neoprene having a nylon jersey laminated on one side thereof and lycra spandex material on the opposite side thereof. The laminated material thus is very soft and stretchable which adds to the comfort of the finished belt to the diver. A flap of the material is folded upward and stitched along lines 12 to form a series of pockets 14. While five pockets are shown in the drawing, the number will depend upon the length of the belt. Thus, seams 12 and an upper opening 17 define pockets 14.

A standard diver's lead weight 22 will fit snugly into pocket 17 through opening 32 as indicated by the arrows. Weights 22 are made in various sizes from one pound to five pounds, in one pound increments. Thus, a five pocket belt may hold a maximum of 25 pounds of weights. The stretchability of the foam neoprene material results in the weights fitting pocket 17 snugly regardless of their thickness. A flap 15 extends upward from pockets 17 and may be folded over pockets 17 as best seen in the cross sectional view of FIG. 2. A strip of hook-type Velcro ® is sewed across all of the pockets as indicated at 14. A complementary strip of the loop-type Velcro ® 16 is sewed to the inner side of flap 15. Thus, when flap 15 is folded over the pockets 17, the Velcro ® strips will interlock, forming a secure closure of the pockets.

Each end of belt 10 has a belt coupling portion 13 and 11 extending therefrom. The inner surface of belt end 11 has a strip of loop-type Velcro ® attached thereto while the opposite end 13 has the hook-type Velcro ® disposed thereon. After the weights are installed and flap 15 closed the belt is placed around the diver's waist with the flap portion toward the body and the belt is closed around the waist by Velcro ® pads 18 and 20.

Since each weight 22 is in a separate pocket the weights are secure and cannot slide or change position on the diver. As may be understood, where several weights are in use, they may be distributed in a balanced configuration.

Figure 2:
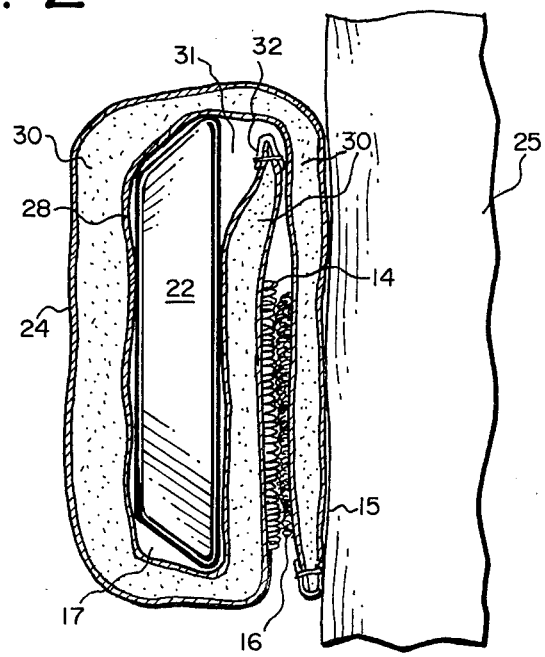
FIG. 2 is a cross section through a pocket of the weight belt of FIG. 1 against the body of a diver showing the padding effect of the weight belt.

Turning now to FIG. 2, a cross section of a pocket 17 having a weight 22 therein is shown. The diver's waist is indicated at 25. The exterior surface 24 of belt 10 may be lycra spandex with the interior surface 28 being of nylon jersey. The open cell neoprene 30 is laminated between the outer material 24 and the inner material 28. Pocket 17 is formed by seams 12 seen in FIG. 1 and having an opening thereto formed by end portion 32. In FIG. 2, flap 15 has been folded over pocket 17 such that the loop type Velcro ® strip 15 will securely fasten to the hook type Velcro ® 14. As may be understood from the cross sectional view of FIG. 2, there are two layers of the foam filled material between the diver's body 25 and weight 22 in addition to the interlocked Velcro ® strips. This combination provides soft cushioning between the weight 22 and the diver's body 25 permitting the belt to be worn with comfort. Advantageously, the totally enclosed weight and the cushioning effect of the belt will prevent accidental injury to the diver from weights 22 even if the belt is bumped against pilings, boat hulls, or other obstacles that a diver may encounter. Similarly, weight 22 can not produce damage to finished surfaces and the like when accidently bumped.

While wearing the belt, the diver's body 25 serves to hold flap 15 securely against pocket 17 completely eliminating any possibility of a weight either slipping or falling out of the belt during swimming movements.

If, in an emergency, a diver wishes to get rid of the belt he need only grasp belt end 11 to rip Velcro ® pad 18 from Velcro ® pad 20 at which point the belt would fall free. If the diver wishes to add or take out weights, he may do so without removing the belt from his waist, although changing of weights is somewhat simpler by opening the belt which can be done quickly and easily.

Although the diver's weight belt disclosed herein has been described with respect to certain materials and construction, it will be obvious to those of skill in the art to make various changes, such as other types of padded materials, changes in number of pockets, and other types of closures, such as snaps, or other well known fasteners. Such changes are considered to be within the spirit and scope of the invention.

I claim:

1. A diver's weight belt comprising:

a belt having an outer surface and an inner surface, said inner surface worn toward the diver's body, said belt formed from cushioned material and having a length sufficient to reach around a diver's waist;

a plurality of pockets attached to said belt, said pockets formed from said cushioned material;

diving weights disposed in said pockets;

a single pad formed from said cushioned material and upwardly extending from said pockets and folded back and over said belt in a manner to close said pockets, said folded pad disposed along said inner surface of said pad thereby forming a double cushion between said diving weights and a diver's body and forming means for preventing accidential loss of said weights during use of said belt;

closure means attached to said pad and to said inner surface of said belt for holding said pockets closed when said pad is folded over said pockets; and belt ends having belt buckling means associated with each end thereof, said buckling means adapted to close said belt around a diver's waist with said pad in contact with a diver's body.

2. The belt as defined in claim 1 in which said pockets are formed to be essentially rectangular to accept rectangular lead diver's weights.

3. The belt as defined in claim 1 in which said belt buckling means is formed by complementary Velcro ® strips attached to said belt ends.

4. The belt as defined in claim 1 in which said closure means is formed by complementary Velcro ® strips attached to said pad and said inner surface of said belt.

5. The belt as defined in claim 1 in which said cushioned material is fabric covered opencell foam neoprene.

6. The belt as defined in claim 5 in which said fabric on one surface of said neoprene is lycra and on the other surface thereof is nylon jersey.

7. The belt as defined in claim 5 in which said pockets are rectangular in shape to accept rectangular lead weights.

8. A diver's weight belt comprising:

(a) an elongate strip of open-cell foam neoprene material having a stretchable fabric covering forming a cushioned belt, said strip having an inner surface to be worn toward the diver's body, and having sufficient length to encircle a diver's waist with an overlap of the strip ends;

(b) a plurality of upward opening pockets disposed along said strip except along said strip ends, said pockets having a shape and size to accept and hold rectangular lead diving weights;

(c) safety closure means for preventing accidental loss of weights during use of said belt, said means including a pad of said neoprene material coextensive with said pockets and extending upwardly therefrom to form an elongate flap, said pad adapted to fold over said belt for closure of said pockets in a manner securing said flap between the diver's body and said inner surface of said strip, said closure means also providing double padding between the diver's body and weights held in said pockets, said closure means having first hook and loop closure material fastened to said inner surface of said pad and to the inner surface of said strip for holding said flap closed over said strip; and (d) second hook and loop closure material fastened to the inner surface of one of said strip ends and to the outer surface of the other of said strip ends for closing said strip around the diver's waist in belt fashion whereby said pad portion is in contact with the diver's body.

* * * * *